US007239269B2

(12) United States Patent
Nozawa

(10) Patent No.: US 7,239,269 B2
(45) Date of Patent: Jul. 3, 2007

(54) SYSTEM AND METHOD FOR PROVIDING GOLF PLAY INFORMATION, PORTABLE TERMINAL, AND SERVER USED FOR THE SAME

(75) Inventor: Tadahiro Nozawa, Tokyo (JP)

(73) Assignee: NEC Corporation (JP)

( * ) Notice: Subject to any disclaimer, the term of this patent is extended or adjusted under 35 U.S.C. 154(b) by 359 days.

(21) Appl. No.: 10/902,364

(22) Filed: Jul. 29, 2004

(65) Prior Publication Data

US 2005/0030223 A1 Feb. 10, 2005

(30) Foreign Application Priority Data

Aug. 6, 2003 (JP) ..... 2003-288258

(51) Int. Cl.
*G01S 5/14* (2006.01)

(52) U.S. Cl. ..... 342/357.06; 463/3

(58) Field of Classification Search ..... 342/357.01, 342/357.06, 357.08, 357.13; 701/208, 213, 701/215; 700/91, 93; 463/1, 3; 273/108.2, 273/245, 317.2

See application file for complete search history.

(56) References Cited

U.S. PATENT DOCUMENTS

| | | | | |
|---|---|---|---|---|
| 5,772,534 | A * | 6/1998 | Dudley | 473/407 |
| 6,236,940 | B1 * | 5/2001 | Rudow et al. | 701/300 |
| 2002/0161461 | A1 | 10/2002 | Lobb et al. | 700/91 |
| 2002/0188359 | A1 | 12/2002 | Morse | 700/91 |

FOREIGN PATENT DOCUMENTS

| | | |
|---|---|---|
| JP | 04-020360 | 1/1992 |
| JP | 2001-000618 | 1/2001 |
| JP | 2001-319154 | 11/2001 |
| JP | 2002-000786 | 1/2002 |
| WO | WO 96/21161 | 7/1996 |
| WO | WO 97/02873 | 1/1997 |

* cited by examiner

*Primary Examiner*—Dao L. Phan
(74) *Attorney, Agent, or Firm*—Hayes Soloway P.C.

(57) ABSTRACT

A golf play information providing system includes a portable terminal and a server communicating with the terminal. A terminal receives an input of golf course information and customer information obtained based on position information from a GPS satellite, a GPS pseudo satellite, and an MTSAT (Multi-functional Transport Satellite) and to transfer the golf course information and customer information to the server. A server updates golf curse and customer information previously stored in the server with the latest information. The server transfers the updated golf course and customer information to the terminal. The terminal displays the golf course and customer information that have been transmitted from the server. The server registers, corrects, and deletes contents of the customer information. The terminal calculates, on the golf course, the current position based on the position information to display golf course information related to the calculated current position. The terminal sets, on the golf course, a target position on its screen that displays the current position based on the position information to calculate and display the distance between the current position and target position. Then, the terminal transfers, to the server, the golf course and customer information stored in the terminal to update the golf course and customer information in the server.

12 Claims, 7 Drawing Sheets

SYSTEM AND METHOD FOR PROVIDING GOLF PLAY INFORMATION, PORTABLE TERMINAL, AND SERVER USED FOR THE SAME

BACKGROUND OF THE INVENTION

1. Field of the Invention

The present invention relates to a system and method for providing golf play information concerning golf play to a player on the course, and more particularly, to a golf play information communication providing system and method using a portable terminal for the player and a server which communicates with the portable terminal.

2. Description of the Related Art

In golf play, it is very important for a player to accurately grasp course layout or course yardage. Conventionally, a player has determined it by a course picture, or a visual measurement using a yardage marker (distance indication post). Alternatively, the player has determined it on caddy's advice. Many players have experience of making an error in measurement of the yardage, or being suffering from an unexpected course layout such as a pond or bunker.

As an example of the prior art for solving the above problem involving golf play, "Method of acquisition and distribution business of golf course map data for GPS (Global Positioning System)" is known (refer to, for example, JP-A-2001-319154). In the method, plural pieces of golf course map data for GPS are registered in a database connected to a network, and desired golf course map data is downloaded from the database to a user terminal.

As another example, "Information processing system" is known (refer to, for example, JP-A-2002-000786). In the system, based on current position coordinate (golf ball position) acquired from a GPS and target position coordinate acquired by pointing a target position on a course map displayed on a PDA (Personal Digital Assistant), the accurate distance between the golf ball position and the target position is obtained.

However, in the above invention disclosed in JP-A-2001-319154, information related to golf play that can actually be acquired by a player by means of a terminal is limited to invariant information representing land features or the like of the golf courses that have previously registered in the database.

Accordingly, the player cannot acquire course condition information (weather, wind, ground condition) or the like, and therefore he or she cannot reflect the course condition information varying from hour to hour on his or her play in real time, which makes it difficult for the player to enjoy situational plays.

Further, in the above invention disclosed in JP-A-2002-000786, although the player can acquire the accurate distance between the golf ball position and target position, he or she cannot acquire information such as land features of the golf courses, course condition information or the like that is actually required for golf play. In addition, the accurate position information cannot be acquired only from a GPS satellite.

SUMMARY OF THE INVENTION

The present invention has been made in view of the above situation, and an object thereof is to provide a golf play information providing system and a golf play information providing method capable of providing sufficient satisfaction for a service user (player), more specifically, to provide a golf play information providing system and a golf play information providing method capable of: displaying the accurate current position of the player as well as accurate distance to a target position by providing a GPS pseudo-satellite above a golf course in addition to a GPS satellite or by using a GPS satellite and an MTSAT (Multi-functional Transport Satellite); reflecting course condition information varying from hour to hour on golf play in real time by inputting information related to a golf course from a terminal; eliminating waste of supplies such as a score card or a pencil by using a score display function; assisting the player to record rounds by displaying, saving and printing trails of the player; utilizing information that is required for the player and a service provider by creating accurate log data.

To achieve the above object, according to a first aspect of the present invention, there is provided a golf play information providing system comprising: a portable terminal which calculates a current position based on position information transmitted from a GPS satellite and GPS pseudo satellite, or the GPS satellite and an MTSAT (Multi-functional Transport Satellite), and displays information including the current position on a screen thereof; and a server which communicates with the portable terminal, and stores golf course information concerning a golf course and customer information concerning customers as golf players in a database.

In the system, the portable terminal includes: first input means for inputting the golf course information based on the position information, and for transmitting it to the server; second input means for inputting the customer information, and for transmitting it to the server; displaying means for displaying the golf course information and customer information transmitted from the server on the screen; calculating means for calculating a current position on the golf course based on the position information, and for displaying golf course information concerning the calculated current position on the screen; setting means for setting a target position on the screen of the portable terminal that displays the current position based on the position information, for calculating a distance between the current position and the set target position, and for displaying the calculated distance on the screen; and transmitting means for transmitting, to the server, the golf course information and customer information stored in the portable terminal to update the golf course information and customer information in the database.

In the system, the server includes: first updating means for updating the golf course information previously stored in the database with the received latest golf course information; second updating means for updating the customer information previously stored in the database with the received latest customer information; transmitting means for transmitting the updated golf course information and customer information to the portable terminal; and means for registering, correcting, and deleting contents of the customer information transmitted by the portable terminal on the database.

The golf course information may include at least one of a teeing ground to be played, revised course layout, pin position of the day, tee shot position, and hole position. The customer information may include at least one of player's name, handicap, score, event hole, club, and previous score.

The display means may display the golf course information in a two-dimensional (2D) or three-dimensional (3D) manner. The display means may display the golf course information in a standard or enlarged mode on the screen.

The portable terminal may further include transmitting means for transmitting, to the server, the round information including play trails of the player to update the customer information stored in the server. The round information may be output from the customer information stored in the server.

According to a second aspect of the present invention, there is provided a golf play information providing method for use in a golf play information providing system which comprises: a portable terminal which calculates a current position based on position information transmitted from a GPS satellite and GPS pseudo satellite, or a GPS satellite and MTSAT (Multi-functional Transport Satellite), and displays information including the current position on a screen thereof; and a server which communicates with the portable terminal, and stores golf course information concerning a golf course and customer information concerning customers as golf players in a database.

The method comprises the steps of: (i) at the portable terminal, (a) inputting the golf course information based on the position information to transmit it to the server, and (b) inputting the customer information to transmit it to the server; (ii) at the sever, (a) updating the golf course information previously stored in the database with the received latest golf course information, (b) updating the customer information previously stored in the database with the received latest customer information, and (c) transmitting the updated golf course information and customer information to the portable terminal; (iii) at the portable terminal, (a) displaying the golf course information and customer information transmitted from the server on the screen; (iv) at the the server, (a) registering, correcting, and deleting contents of the customer information transmitted from the portable terminal on the screen; and (v) at the portable terminal, (a) on the golf course, calculating the current position based on the position information to display golf course information concerning the calculated current position on the screen, (b) on the golf course, setting a target position on the screen of the portable terminal that displays the current position based on the position information to calculate and display the distance between the current position and the set target position, and (c) transmitting, to the server, the golf course information and customer information stored in the portable terminal to update the golf course information and customer information in the database.

The method may further comprise the step of (vi) at the portable terminal, (a) transmitting, to the server, the round information including play trails of the player to update the customer information stored in the server.

According to a third aspect of the present invention, there is provided a portable terminal used for a golf play information providing system comprising a server which communicates with the portable terminal, the server including a database for storing golf course information concerning a golf course and customer information concerning customers as golf players.

The portable terminal comprises: a controller; a receiver, connected to the controller, for receiving position information transmitted from a GPS satellite and GPS pseudo satellite, or the GPS satellite and an MTSAT (Multi-functional Transport Satellite); communication means, connected to the controller, for communicating with the server; input means connected to the controller; and display means connected to the controller.

In the terminal, the controller is configured to: (a) input the golf course information based on the position information to transmit it to the server via the communication means; (b) input the customer information to transmit it to the server via the communication means; (c) display, on a screen of the display means, the golf course information and customer information transferred from the server; (d) calculate the current position on the golf course based on the position information to display, on the screen of the display means, golf course information concerning the calculated current position; (e) set a target position on the screen of the display means that displays the current position based on the position information, to calculate a distance between the current position and the set target position, and to display the calculated distance on the screen of display means; and (f) transmit, to the server via the communication means, the golf course information and customer information stored in the portable terminal so as to update the golf course information and customer information in the database of the server.

In the terminal, the controller may be further configured to: (g) transmit, to the server via the communication means, round information including play trails of a player to update the customer information stored in the server.

According to a forth aspect of the present invention, there is provided a server, which communicates with a portable terminal used for a golf play information providing system, comprising; a controller; communication means, connected to the controller, for communicating with the portable terminal; and a database, connected to the controller, for storing golf course information concerning a golf course and customer information concerning customers as golf players.

In the server, the controller is configured to: (a) update the golf course information previously stored in the database with the received latest golf course information; (b) update the customer information previously stored in the database with the received latest customer information; (c) transmit the updated golf course information and customer information to the portable terminal via the communication means; and (d) register, correct, and delete contents of the customer information transmitted to the portable terminal on the database.

A first advantage of the present invention is that a service provider (golf data management operator) can realize cost-saving. The service provider can reduce labor costs on exclusive caddies by using this system. Further, consumable goods like paper score cards or pencils become needless.

A second advantage of the present invention is that the service provider obtains differentiation perceived as added value by a user. The provider can provide useful information for future play to a user by storing playing histories of all players or applicants. Further, storing course trails of the player secures repeat customers. Thus, from the viewpoint of the service provider, this system can be the killer service for acquiring new customers.

A third advantage of the present invention is that acquiring the latest information such as golf course information related to the course or hole using a portable device allows the player to reflect the latest information on his or her play in real time, so that the player can enjoy golf play more pleasantly.

DETAILED DESCRIPTION OF THE PREFERRED EMBODIMENTS

An embodiment of the present invention will be described hereinafter in detail with reference to the accompanying drawings. The present invention uses a GPS system, a GPS pseudo satellite system, and an MTSAT to acquire a position calculation and display terminal that a user (player) carries with him or her and provide information to the user.

Figure 1:
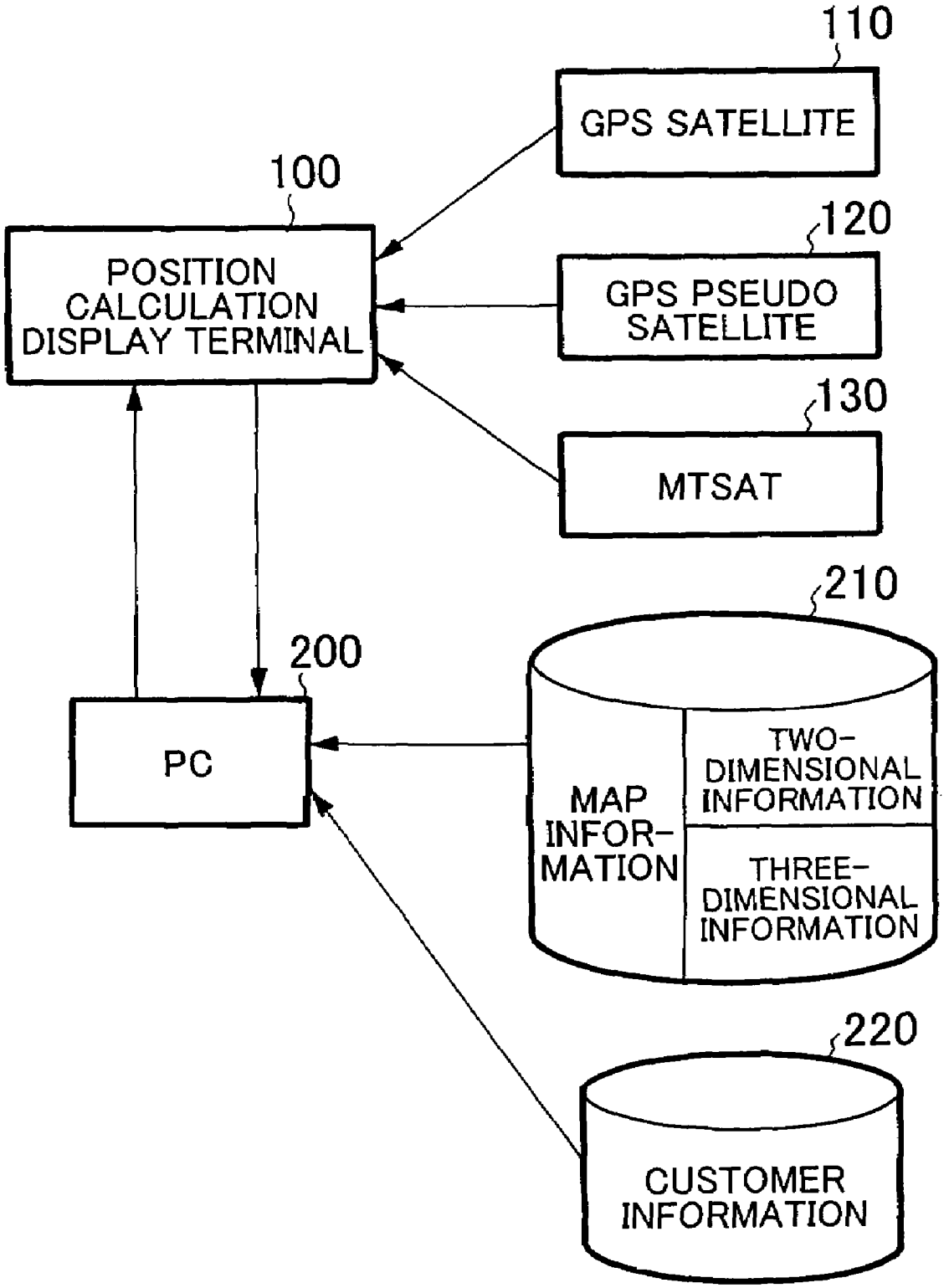
FIG. 1 is a block diagram schematically showing the system configuration of an embodiment of the present invention.

In FIG. 1, there is provided a golf play information providing system. This system comprises: a position calculation display terminal 100 serving as a portable terminal which is a handheld device and calculates the current position based on position information transmitted from a GPS satellite 110, GPS pseudo satellite 120, or a MTSAT 130; and a personal computer (PC) 200 serving as a server which communicates with the display terminal 100. The PC 200 includes a database in which golf course position information 210 and customer information 220 are stored. The position information 210 includes two-dimensional and three-dimensional map information around the course, and course condition information indicating weather or wind, teeing ground to be played, pin position of the day, or the like. The customer information 220 includes information concerning player, handicap, score, event hole, club, previous score, etc.

In the system, the display terminal 100 inputs information related to a teeing ground to be played, a revised course layout, a pin position and the like based on position information transmitted from the GPS satellite 110, the GPS pseudo satellite 120, or the MTSAT 130.

When the display terminal 100 is connected to the PC 200, the position information 210 stored in the database on the PC 200 is updated with the latest information such as course condition information indicating weather or wind, teeing ground to be played, pin position of the day, or the like. The customer information 220 stored in the database on the PC 200 is also updated with the latest customer information such as player, handicap, score, event hole, club, previous score, etc. These updated position information 210 and customer information 220 are transmitted to the display terminal 100.

The display terminal 100 displays the position information 210 and customer information 220 transmitted from the PC 200. The data of customer information 220 transferred from the PC 200 are registered, corrected or deleted on the display terminal 100.

When the player carries the display terminal 100 with him or her around the course, the display terminal 100 calculates a current position based on the position information transmitted from the GPS satellite 110, GPS pseudo satellite 120, or MTSAT 130 and to automatically display, in a 2D or 3D manner, course or green information relating the current position on which the player stands.

And also, when the player sets a target position on it, the display terminal 100 calculates the distance between the current position specified based on the displayed the position information and the target position, and displays the calculation result. The data stored in the display terminal 100 are transmitted to the PC 200 for update.

(First Example)

First, a configuration of a first example of the present invention will be described. Referring to FIG. 1, in a golf play information providing system and a golf play information providing method using a GPS satellite and a GPS pseudo satellite or an MTSAT, which is the first example of the present invention, the position calculation display terminal 100 can perform a data transfer with the PC 200.

The display terminal 100 is configured to operate within the service area (area of radio wave propagation) of the GPS satellite 110, GPS pseudo satellite 120, and MTSAT 130. The display terminal 100 may be a dedicated terminal for the system of the first example, or a widely used terminal such as a portable PC, a PDA, a mobile phone and the like, as far as it can calculate a current position thereof based on the position information acquired from the GPS, and can connect to the Internet.

The display terminal 100 displays the latest map information and customer information which are transmitted from the PC 200, and accurately calculates the position of the user based on the position information from the GPS satellite 110, GPS pseudo satellite 120, and MTSAT 130. The display terminal 100 connects to the PC 200 to download the most recently updated information. The information transmitted from the PC 200 is corrected or updated by the user's operation. Then the display terminal 100 uploads the corrected or newly registered information to the PC 200.

Further, the display terminal 100 can display, on the map information downloaded from the PC 200, information concerning a current position or a destination position acquired from the position information of the GPS satellite 110, GPS pseudo satellite 120, and MTSAT 130, and calculates the distance that the user requires based on the map information downloaded from the PC 200 and information acquired from the GPS satellite 110, GPS pseudo satellite 120, and MTSAT 130 so as to display the calculation result on the screen.

Further, the display terminal 100 has a function of recording the trail of the user based on the position information acquired from the GPS satellite 110, GPS pseudo satellite 120, and MTSAT 130.

Figure 2:
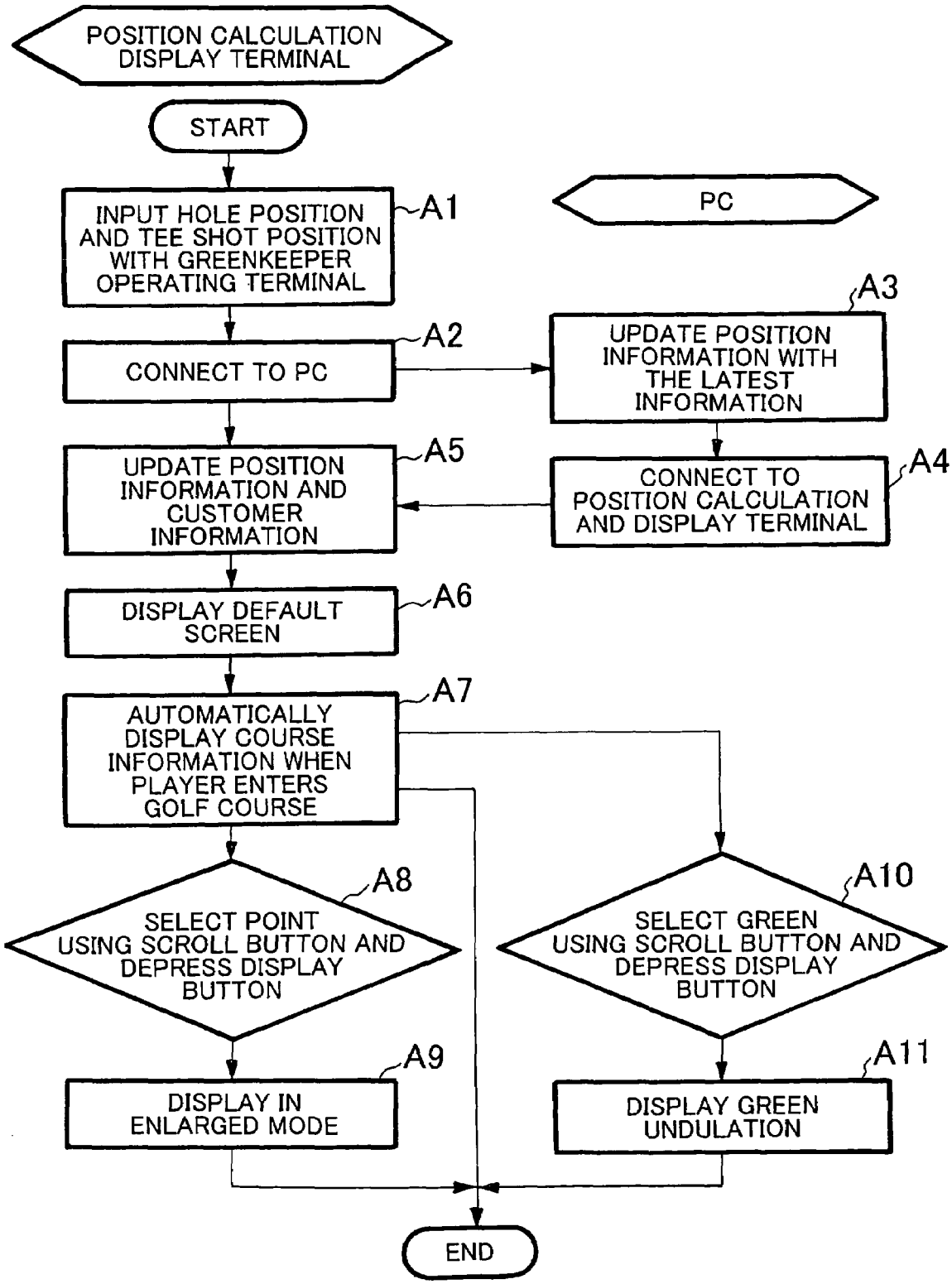
FIG. 2 is a flowchart showing a first processing operation of a first example of the present invention.

Next, a first operation of the first example will be described below in detail with reference to FIGS. 1 and 2. Referring to FIG. 2, a greenkeeper switches a predetermined mode of the display terminal 100 to a course information input mode using a hidden command (special operation prepared for the greenkeeper). The greenkeeper inputs hole information such as a hole position or tee shot position of the day on a screen of the display terminal 100 by specifying a desired position in each hole (step A1). A service provider connects the display terminal 100 that has received the input from the greenkeeper to the PC 200 (step A2), and then transmits the golf course position information 210 to the PC 200 with the latest information for update (step A3).

When the service provider connects the display terminal 100 to the PC 200 (step A4), the PC 200 downloads the information on the golf course position information 210 and customer information 220 to the display terminal 100 (step A5). The display terminal 100 displays a default screen (step A6). When the player (user) enters the course, the display terminal 100 automatically switches a display mode from the default screen to the screen that displays, in a 2D or 3D manner, the information on the course that the player has entered, based on the position information transmitted from the GPS satellite 110, GPS pseudo satellite 120, or MTSAT 130 (step A7).

The display terminal 100 can display "through the green" from a predetermined position on the course. The player selects a desired point on the course by a cursor and depresses a display button (step A8). The display terminal 100 then displays, in a 2D or 3D manner, a scenery viewed from the selected point in the direction that the player has specified in a standard mode or enlarged mode based on the position information transmitted from the GPS satellite 110, GPS pseudo satellite 120, or MTSAT 130 (step A9). When the player wants to check undulation of the green, he or she moves a cursor to a target green and depresses a display button (step A10). The display terminal 100 displays the green undulation on the screen thereof (step A11).

Figure 3:
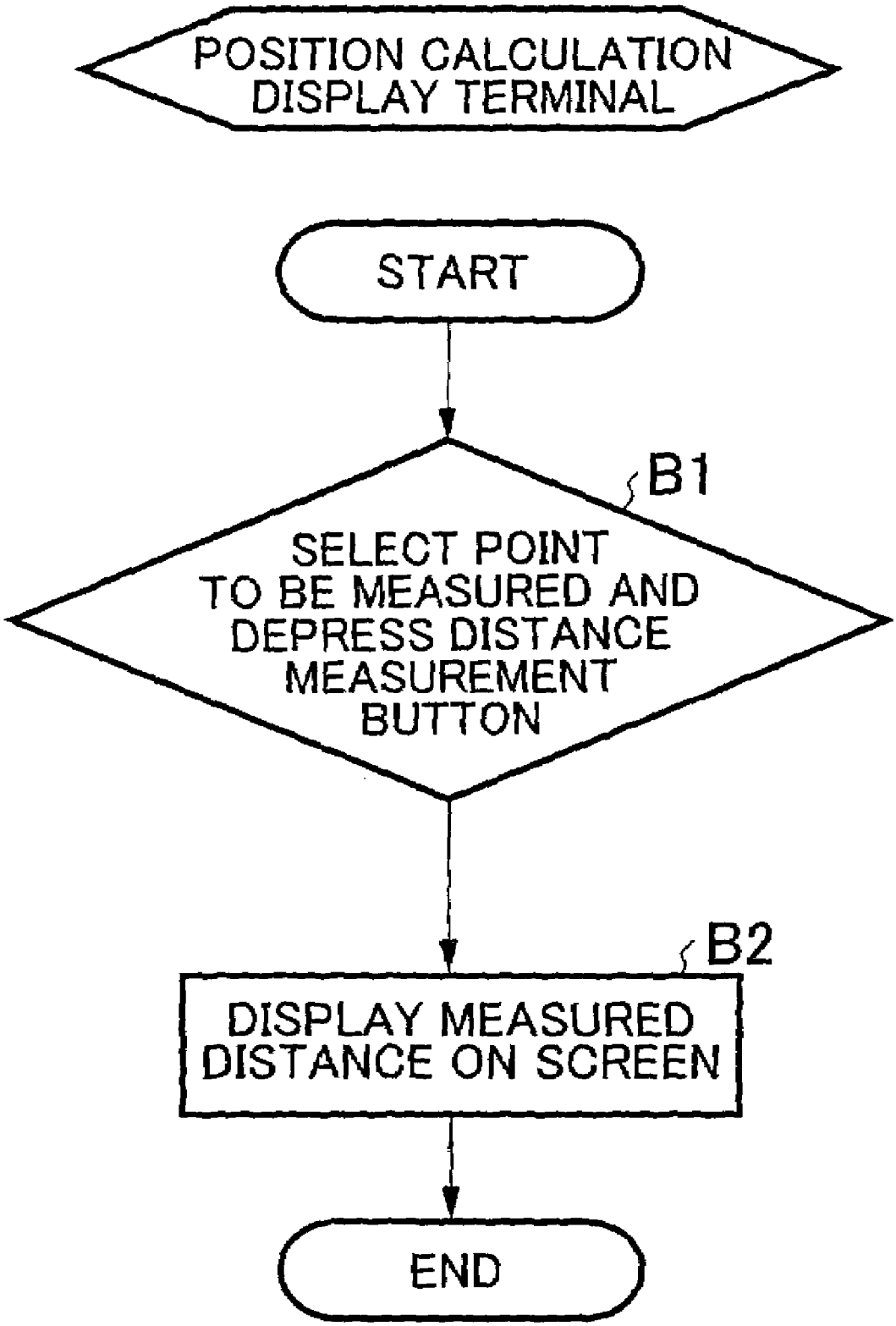
FIG. 3 is a flowchart showing a second processing operation of the first example of the present invention.

Next, a second operation of the first example will be described with reference to FIG. 3. Referring to FIG. 3, when the player performs a distant measurement, he or she moves a cursor from a current position to a target position for pointing or specifies two target positions, and then depresses a distance measurement button (step B1). The display terminal 100 automatically measures the distance that the player requires based on the position information transmitted from the GPS satellite 110, GPS pseudo satellite 120, or MTSAT 130, and displays the distance (measurement result) on the screen thereof (step B2).

(Second Example)

Figure 4:
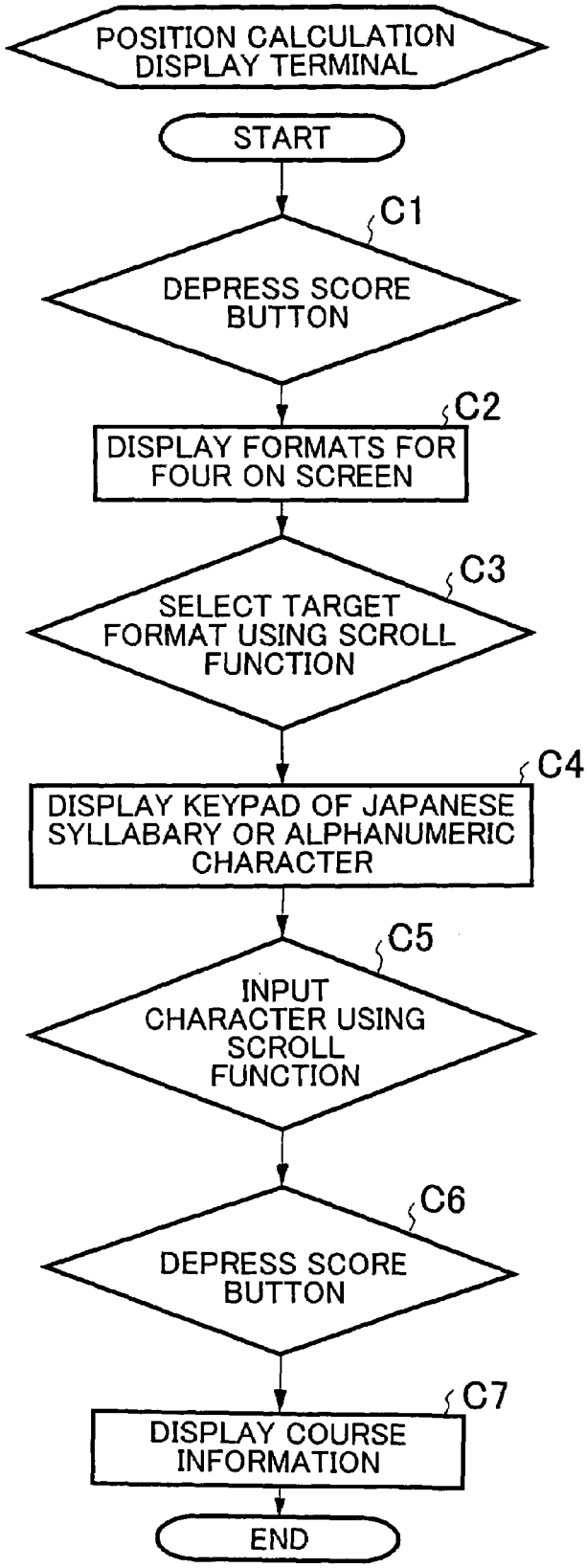
FIG. 4 is a flowchart showing a processing operation of a second example of the present invention.

Next, a second example of the present invention will be described below in detail with reference to FIG. 4.

The player depresses a score button of the display terminal 100 (step C1). The display terminal 100 displays formats for four players on the screen thereof (step C2). The player scrolls the screen to select a target format (step C3). The display terminal 100 displays a character input screen (step C4). The player uses a character input function to input player's name, or scores of each hole (step C5).

After the input, the player depresses a score button (step C6). The display terminal 100 automatically displays, in a 2D or 3D manner, the relevant course information based on the position information transmitted from the GPS satellite 110, GPS pseudo satellite 120, or MTSAT 130 (step C7).

(Third Example)

Figure 5:
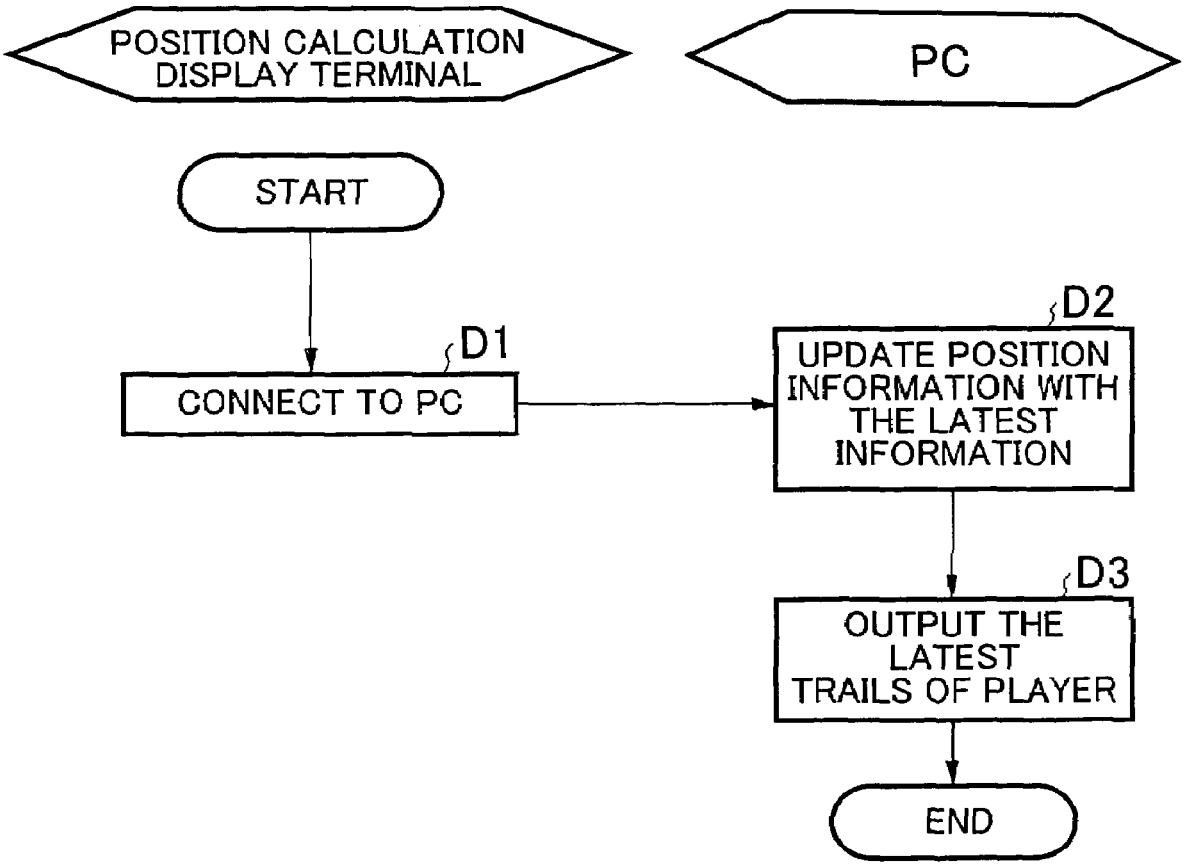
FIG. 5 is a flowchart showing a processing operation of a third example of the present invention.

Next, a third example of the present invention will be described below in detail with reference to FIG. 5.

The display terminal 100 is connected to the PC 200 (step D1). The connection established between the display terminal 100 and PC 200 allows round information including play trails of the player in the customer information 220 on the PC 200 to be updated (step D2). The service provider allows the PC 200 to output the latest play trails of the player from the customer information 220, as needed (step D3).

Figure 6A:
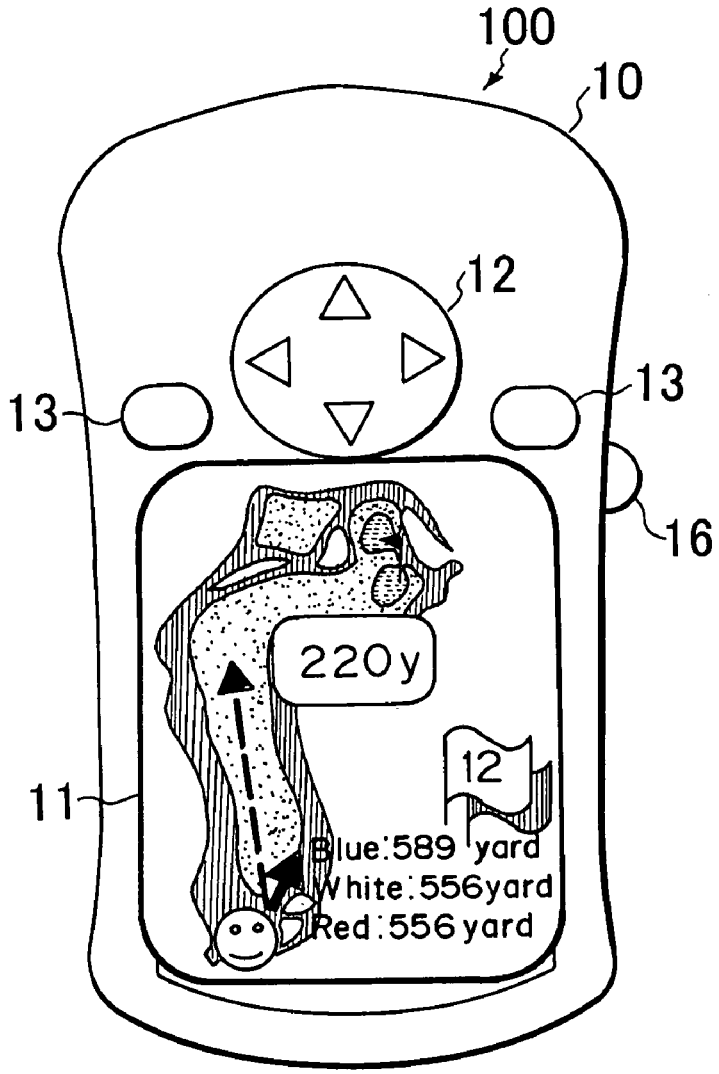
FIGS. 6A, 6B and 6C are a front view showing a configuration example of a position calculation terminal (portable terminal) for use in the embodiment of the present invention, a right side view of the same, and a top view of the same, respectively.
Figure 6B:
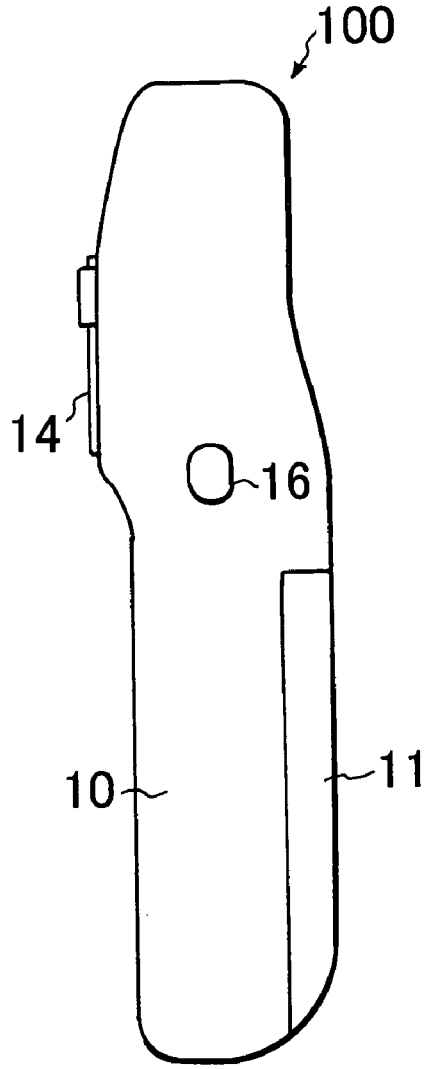
Figure 6C:
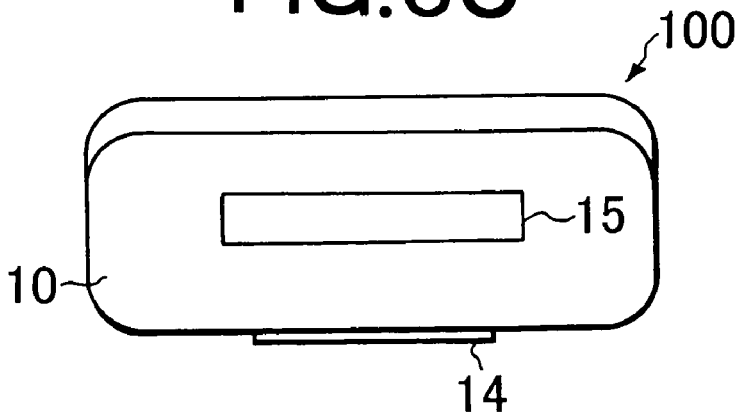
Figure 7:
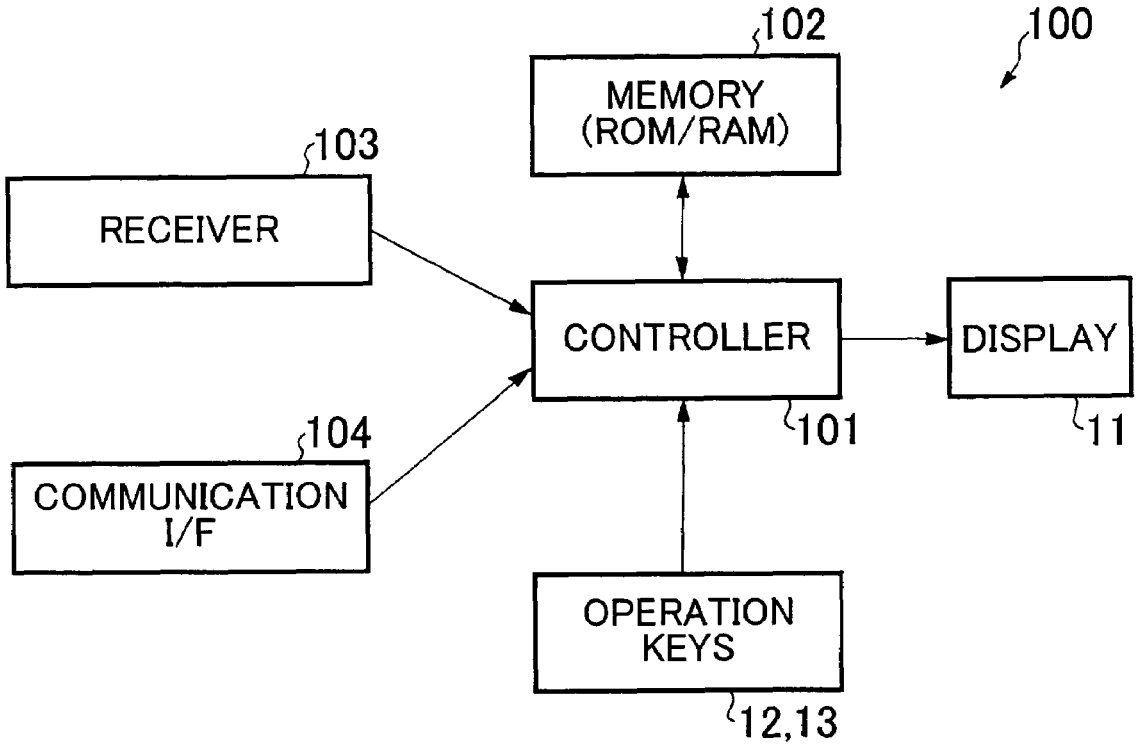
FIG. 7 is a block diagram schematically showing configuration example of a position calculation terminal (portable terminal) for use in the embodiments of the present invention.

Next, a configuration example of the position calculation display terminal 100 for use in the above examples is shown in FIGS. 6A to 6C and FIG. 7. FIG. 6A is a front view of the display terminal 100, FIG. 6B is a right side view of the same, and FIG. 6C is a top view of the same. FIG. 7 is a block diagram of the display terminal 100. The configuration shown in FIGS. 6A to 6C and FIG. 7 is taken as one example, and the present invention is not limited to this. The display terminal 100 may have any configuration as far as it can achieve the same function as that in the above examples.

The display terminal 100 shown in FIGS. 6A to 6C is used as a terminal dedicated for the system. As a means for communicating data with the PC 200, the display terminal 100 includes at least one of the communication means using a cable between the connector connection, that using infrared ray conforming to IrDA (Infrared Data Association) standard, and that using wireless communication such as RFID (Radio Frequency Identification).

In the example shown in FIGS. 6A to 6C, the display terminal 100 has a palm-size main body 10 having a user-friendly shape, so that the user easily operates the display terminal 100 with his or her hand. The main body 10 has, on the front side thereof, a display 11 such as a liquid crystal display or the like, an operation key 12 for specifying four directions (up, down, left, right) that is operable by the operator, and a plurality (two, in the drawing) of operation keys 13 for executing functions, for example, for determining a desired operation. Reference numbers 14, 15, and 16 denote a hook for hooking the main body 10 to a user's belt disposed on the back side of the main body 10, a cover of connection connecters which are used for PC connection, battery connection, and the like, the connection connectors and cover being disposed on the upper surface side of the main body 10, and a rubber cover of the connector for battery connection disposed on the side surface side of the main body 10, respectively.

As shown in FIG. 6A, the display 11 is disposed at the center to lower portion on the front side of the main body 10, the operation key 12 for specifying four directions is disposed at the upper portion on the front side of the main body 10, and the operation keys 13, 13 are respectively disposed at the left and right positions that sandwich the operation key 12 for specifying four directions on the front side of the main body 10.

The operation key 12 for specifying four directions and operation keys 13, 13 are individually or simultaneously operated, in collaboration with a displayed screen on the display 11 to realize all functions. For example, in the case of character input operation, the following operations are available: (1) a candidate (candidates) of an input character is displayed on the screen of the display 11, the candidate (candidates) of an input character on the screen is changed to the next candidate (candidates) by manipulations of the operation key 12 in right to left direction and up to down direction in a state where the cursor not being moved, and the right operation button 13, which is allowed to serve as a determination key, is depressed to determine the input character; (2) an input character panel of Japanese syllabary or alphanumeric character is displayed on the screen of the display 11, and a desired character is selected using the operation key 12 and determined by pressing the determination key.

ON/OFF operation of the functions of "display button" and "score button" described in the above examples can be realized by displaying the "display button" or "score button" on a predetermined position within the display 11 and depressing the operation key 12 or 13 that has been assigned as the determination key.

The displayed image on the screen of the display portion 11 shown in FIG. 6A is an example of course information required for a golf player. This image has been generally displayed by a sign standing at the teeing ground on each hole or carried on a cart as hole information on a paper basis. In the displayed image exemplified, "220y" denotes the distance to a target, "Blue: 589 yard" denotes the distance between a blue tee and a target green ("White: 556 yard" and "Red: 556 yard" denote the same thing), a dotted arrow denotes the direction to the target, a thick arrow denotes the direction that the player faces, and a face mark denotes the player's current position.

As shown in FIG. 7, the display terminal 100 includes in the main body 10 thereof, in addition to the display 11 and various operation keys 12 and 13, e.g., a controller (processor) 101 such as a CPU which operates by program control, memory (ROM and/or RAM) 102 for storing control program and control data, a receiver 103 having a well-known configuration and receiving position information from the GPS satellite 110, GPS pseudo satellite 120, and MTSAT 130, a communication interface (I/F) 104 used for the above-mentioned communication means using the cable for the connector connection, infrared ray conforming to IrDA standard, or wireless communication such as RFID, and performing a data communication with the PC 200, and the like.

The aforementioned operations of the display terminal 100 (for example, steps A1 to A2 and A5 to A9 in FIG. 2, steps B1 to B2 in FIG. 3, steps C1 to C7 in FIG. 4, and step D1 in FIG. 5) are carried out through a control program code or processing program code executed by the controller (CPU) 101. The control program code or processing program code for use in the operations is previously set and stored in the memory 102 such as a ROM.

Figure 8:
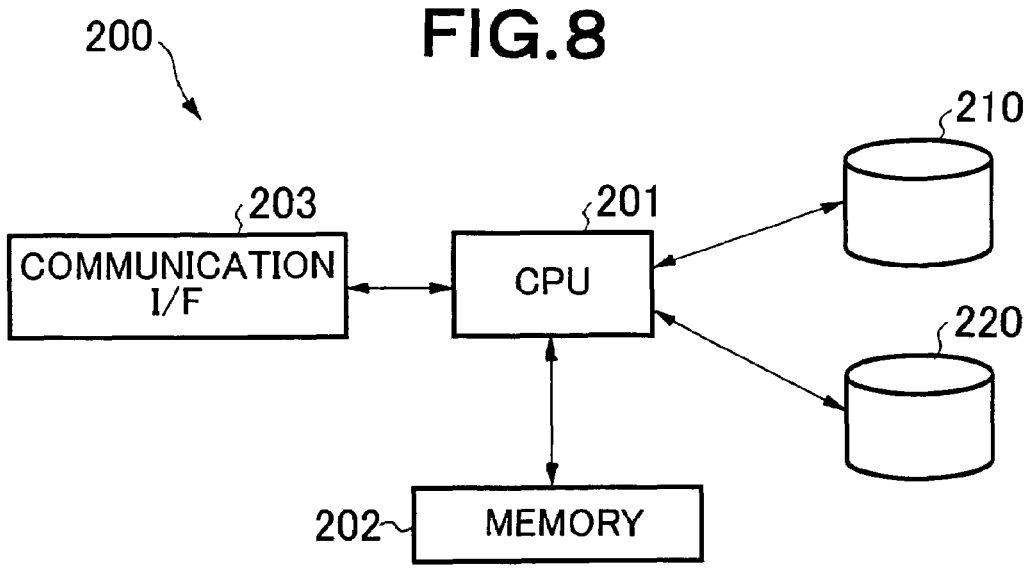
FIG. 8 is a block diagram schematically showing configuration example of a PC (server) for use in the embodiments of the present invention.

FIG. 8 is a block diagram of the server 200. The configuration shown in FIG. 8 is taken as one example, and the present invention is not limited to this. The server 200 may have any configuration as far as it can achieve the same function as that in the above examples.

As shown in FIG. 8, the server 200 comprises a CPU (processor) 201, memory 202 such as a ROM and/or RAM, and columniation I/F 203 for communicating with the display terminal 200, in addition to the database of the golf course position information 210 and customer information 220.

The aforementioned operations, means, and processing steps of the PC 200 (for example, steps A3 to A4 and A10 to A11 in FIG. 2, and steps D2 to D3 in FIG. 5) described in the above examples are also carried out through a control program code or processing program code executed by the CPU 201 mounted in the PC 200. The control program code or processing program code for use in the operations is previously set and stored in the memory 201 such as a ROM or a recording medium such as a hard disk mounted in the PC 200.

The present invention uses GPS system and GPS pseudo satellite system, or GPS system and MTSAT to acquire the position calculation display terminal (portable terminal) that the user carries along with him or her, thereby providing information concerning golf play to the user.

What is claimed is:

1. A golf play information providing system comprising:

a portable terminal which calculates a current position based on position information transmitted from a GPS satellite and a GPS pseudo satellite, or the GPS satellite and an MTSAT (Multi-functional Transport Satellite), and displays information including the current position on a screen thereof; and a server which communicates with the portable terminal, and stores golf course information concerning a golf course and customer information concerning customers as golf players in a database, wherein said portable terminal comprises:

a first input for inputting the golf course information based on the position information, and for transmitting it to the server;

a second input for inputting the customer information, and for transmitting it to the server;

a display terminal for displaying the golf course information and customer information transmitted from the server on the screen;

a calculator for calculating a player's current position on the golf course based on the position information, and for displaying golf course information concerning the player's calculated current position on the screen;

a controller for setting a target position on the screen of the portable terminal that displays the current position based on the position information, for calculating a distance between the current position and the set target position, and for displaying the calculated distance on the screen; and a transmitter for transmitting, to the server, the golf course information and customer information stored in the portable terminal to update the golf course information and customer information in the database, and wherein said server comprises:

a first updating provider for updating the golf course information previously stored in the database with the received latest golf course information;

a second updating provider for updating the customer information previously stored in the database with the received latest customer information;

a transmitter for transmitting the updated golf course information and customer information to the portable terminal; and a database manager for registering, correcting, and deleting contents of the customer information transmitted by the portable terminal on the database.

2. The golf play information providing system according to claim 1, wherein the golf course information includes at least one of teeing ground to be played, revised course layout, pin position of the day, tee shot position, and hole position.

3. The golf play information providing system according to claim 1, wherein the customer information includes at least one of player's name, handicap, score, event hole, club, and previous score.

4. The golf play information providing system according to claim 1, wherein the display terminal displays the golf course information in a two-dimensional or three-dimensional manner on the screen.

5. The golf play information providing system according to claim 1, wherein the display terminal displays the golf course information in a standard or enlarged mode on the screen.

6. The golf play information providing system according to claim 1, wherein the portable terminal further includes a transmitter for transmitting, to the server via a communication device, round information including play trails of a player to update the customer information stored in the server.

7. The golf play information providing system according to claim 6, wherein the round information is output from the customer information stored in the database.

8. A golf play information providing method for use in a golf play information providing system which comprises:

a portable terminal which calculates a current position based on position information transmitted from a GPS satellite and a GPS pseudo satellite, or a GPS satellite and an MTSAT (Multi-functional Transport Satellite), and displays information including the current position on a screen thereof; and a server which communicates with the portable terminal, and stores golf course information concerning a golf course and customer information concerning customers as golf players in a database, said method comprising the steps of:

(i) at the portable terminal, (a) inputting the golf course information based on the position information to transmit it to the server, and (b) inputting the customer information to transmit it to the server;

(ii) at the sever, (a) updating the golf course information previously stored in the database with the received latest golf course information, (b) updating the customer information previously stored in the database with the received latest customer information, and (c) transmitting the updated golf course information and customer information to the portable terminal;

(iii) at the portable terminal, (a) displaying the golf course information and customer information transmitted from the server on the screen;

(iv) at the the server, (a) registering, correcting, and deleting contents of the customer information transmitted from the portable terminal on the screen; and (v) at the portable terminal, (a) on the golf course, calculating a player's current position based on the position information to display golf course information concerning the player's calculated current position on the screen, (b) on the golf course, setting a target position on the screen of the portable terminal that displays the player's current position based on the position information to calculate and display the distance between the current player's position and the set target position, and (c) transmitting, to the server, the golf course information and customer information stored in the portable terminal to update the golf course information and customer information in the database.

9. The golf play information providing method according to claim 8, said method further comprising the step of:

(vi) at the portable terminal, (a) transmitting, to the server, round information including play trails of a player to update the customer information stored in the server.

10. A portable terminal used for a golf play information providing system comprising a server which communicates with the portable terminal, said server including a database for storing golf course information concerning a golf course and customer information concerning customers as golf players, said portable terminal comprising:

a controller;

a receiver, connected to the controller, for receiving position information transmitted from a GPS satellite and a GPS pseudo satellite, or the GPS satellite and an MTSAT (Multi-functional Transport Satellite);

a communication device, connected to the controller, for communicating with the server;

an input connected to the controller; and a display terminal connected to the controller, wherein said controller is configured to:

(a) input the golf course information based on a player's position information to transmit it to the server via the communication device;

(b) input the customer information to transmit it to the server via the communication device;

(c) display, on a screen of the display terminal, the golf course information and customer information transferred from the server;

(d) calculate the current position on the golf course based on the player's position information to display, on the screen of the display terminal, golf course information concerning the calculated current position;

(e) set a target position on the screen of the display terminal which displays the current position based on the player's position information, to calculate a distance between the current position and the set target position, and to display the calculated distance on the screen of display terminal; and (f) transmit, to the server via the communication device, the golf course information and customer information stored in the portable terminal so as to update the golf course information and customer information in the database of the server.

11. The portable terminal according to claim 10, wherein said controller is further configured to:

(g) transmit, to the server via the communication device, round information including play trails of a player to update the customer information stored in the server.

12. A server which communicates with a portable terminal used for a golf play information providing system, said server comprising;

a controller;

a communication device, connected to the controller, for communicating with the portable terminal; and a database, connected to the controller, for storing golf course information concerning a golf course and customer information concerning customers as golf players, wherein the controller is configured to:

(a) update the golf course information previously stored in the database with the received latest golf course information;

(b) update the customer information previously stored in the database with the received latest customer information;

(c) transmit the updated golf course information and customer information to the portable terminal via the communication device; and (d) register, correct, and delete contents of the customer information transmitted to the portable terminal on the database.

* * * * *